US005624246A

United States Patent [19]

Kuhlenschmidt

[11] Patent Number: 5,624,246

[45] Date of Patent: Apr. 29, 1997

[54] HYDRAULIC AMMONIA SOLUTION PUMP

[75] Inventor: Donald Kuhlenschmidt, Evansville, Ind.

[73] Assignee: Gas Research Institute, Chicago, Ill.

[21] Appl. No.: 533,620

[22] Filed: Sep. 25, 1995

[51] Int. Cl.[6] ..... F04B 9/08; F04B 35/02

[52] U.S. Cl. ..... 417/386

[58] Field of Search ..... 417/386, 395; 62/483

[56] References Cited

U.S. PATENT DOCUMENTS

| | | | |
|---|---|---|---|
| 3,473,347 | 10/1969 | Andrews et al. | 62/483 X |
| 4,019,837 | 4/1977 | Eull | 417/386 |
| 4,416,599 | 11/1983 | De Longchamp | 417/386 |
| 4,430,048 | 2/1984 | Fritsch | 417/395 X |
| 5,088,901 | 2/1992 | Brauer | 417/386 |

*Primary Examiner*—Richard E. Gluck

*Attorney, Agent, or Firm*—McAndrews, Held & Malloy, Ltd.

[57] ABSTRACT

The present invention relates to a hydraulic pump for use in an ammonia absorption heating and cooling system. The pump is driven by an electric motor that causes a piston to reciprocate within a cylinder. The piston is hydraulically actuated and allows the piston to pump the ammonia through the absorption heating and cooling system below atmospheric pressure. This is achieved through the inclusion of a plurality of ports bored through the cylinder that allow excess lubricant to exit the cylinder during the compression stroke of the piston. The removal of excess lubricant allows the piston to travel through a full stroke, optimizing efficiency, and allowing the ammonia to pumped at pressures below atmospheric.

14 Claims, 3 Drawing Sheets

10
118
120
20
38
25
36
14
27
124
24
44
27
22
40
42
16
56
68
50
116
116
62
72
98
70
94
85
46
52
28
86
92
66
60
88
26
74
150
100
150
96
58
82
130
78
90
64
54
76
80
84
128
160
136
160
114
26
112
132
134
152
140
154
110
30
32
168
158
134
158
162
166
164
12

HYDRAULIC AMMONIA SOLUTION PUMP

FIELD OF THE INVENTION

The present invention relates generally to a hydraulic pump for pumping a fluid into a system at pressures below atmospheric, and more specifically, relates to a hydraulic pump for use in an ammonia absorption heating and cooling system to pump ammonia into the system at pressures below atmospheric.

BACKGROUND OF THE INVENTION

Hydraulic pumps presently exist in the prior art. These pumps include a diaphragm, an inlet passage, a discharge passage, a transfer chamber filled with a hydraulic fluid that is separated from a pumping chamber by a diaphragm, and a piston assembly defining one end of the transfer chamber and adapted for reciprocating movement between a compression stroke and a return stroke. During operation, the piston moves toward (compression stroke) and away from (return stroke) the diaphragm or into and out of the transfer chamber thereby causing such reciprocating movement to be transferred, via the hydraulic fluid in the transfer chamber, to the diaphragm. As the piston moves away from the diaphragm, the diaphragm flexes away from the transfer chamber, allowing the system fluid, such as ammonia, to be drawn into the pumping chamber through the inlet passage. As the piston moves toward the diaphragm, the diaphragm moves accordingly, flexing away from the pumping chamber and causing the fluid in the transfer chamber to be discharged through the discharge passage.

Although most of the prior diaphragm pumps discussed above functioned sufficiently well when there was a ready supply of hydraulic fluid at the inlet to the pumping chamber, such pumps had a tendency to cavitate in the pumping chamber as there was not always a ready supply of hydraulic fluid available. Attempts to solve this problem have provided a ready supply of hydraulic fluid and thus decreased the rates of cavitation. However, these attempts have invariably provided an excess of hydraulic fluid to the pumping chamber and thus decreased the effective area of the pumping chamber and thus decreased the stroke length of the piston and increased the pressure in pumping chamber. Accordingly, the efficiency of these pumps has suffered as they have not been able to operate at optimum pressures.

Additionally, these prior pumps could not discharge the pumping fluid through the discharge passage into the system below atmospheric pressure. Absorption heating and cooling systems operate more efficiently at pressures below atmospheric. In order to operate more efficiently, these systems typically include a compressor to pressurize the pumping fluid (system solution) to pressures below atmospheric. Applicant has recognized that it would be advantageous to obviate the need for a compressor in the system by providing the solution to the system under atmospheric pressure and still prevent cavitation of the pump.

OBJECTS OF THE INVENTION

It is an object of the present invention to provide a hydraulic pump that can pump system solution at pressures below atmospheric.

It is still another object of the present invention to provide a hydraulic pump that is designed to be used in an ammonia absorption heating and cooling system.

It is a related object of the present invention to provide a pump for an ammonia absorption heating and cooling system that obviates the need for a compressor in the absorption heating and cooling system.

It is another object of the present invention to provide a hydraulic pump that allows for lubricant (hydraulic fluid) to enter and exit the cylinder automatically depending upon the pumps requirements.

It is a related object of the present invention to provide a hydraulic pump that has a plurality of ports formed in the pump cylinder allowing lubricant to enter and exit the cylinder therethrough.

It is a related object of the present invention to provide a hydraulic pump that is designed so that the main body of the pump can be removed for repair or replacement without opening the ammonia absorption heating and cooling system.

It is yet another object of the present invention to provide a hydraulic pump including a piston for applying pressure to a diaphragm to pump system solution.

It is a related object of the present invention to provide a hydraulic pump wherein hydraulic fluid that leaks past the piston during the compression stroke can be replaced on the return (decompression) stroke.

It is still a further object of the present invention to provide a hydraulic pump with a diaphragm that is free floating and not mechanically attached to any component of the pump.

SUMMARY OF THE INVENTION

The disclosed hydraulic pump overcomes these inefficiencies of the prior art by providing a hydraulic pump that is capable of pumping a solution through a system under atmospheric pressure. The hydraulic pump of the present invention includes a pump housing that is filled with a predetermined amount of lubricant (hydraulic fluid). A sealed cylinder is located inside and emersed within the pump housing. The cylinder houses a piston assembly including a connecting rod and a drive piston. The drive piston reciprocates in a compression and decompression stroke within the cylinder to pump system solution.

The drive piston has a bottom portion that communicates with a transfer chamber during the compression and decompression strokes. The transfer chamber houses a diaphragm that separates the transfer chamber into two sections. The first section is in fluid communication with the cylinder and the second section is in fluid communication with the absorption heating and cooling system. As the drive piston moves through its compression stroke, the drive piston forces lubricant from the cylinder into the transfer chamber and into contact with the diaphragm. The pumped lubricant contacts the diaphragm and forces the diaphragm to flex toward the system to pump fluid out of the second section of the transfer chamber. As the drive piston moves through its decompression stroke, suction is applied to the diaphragm causing it to flex away from the second section of the chamber causing system solution to be brought into the first section of the transfer chamber.

The connecting rod of the piston assembly is hollow and has a plurality of ports formed therethrough. The hollow portion of the connecting rod includes a pipe housed therewithin. The pipe is fixed at its base and is open at its top end. The hollow portion allows the connecting rod to freely move up and down over the pipe. As the connecting rod slides up and down, the ports of the connecting rod move relative to the open top of the pipe. When the ports are above the open top of the pipe, lubricant that flows into the cylinder from a lubricant intake valve, flows through the connecting rod ports, into the pipe, down the pipe, and out holes formed through the side of the pipe. The lubricant flows out the holes in the side of the pipe such that the lubricant will be located below the drive piston to fully lubricate the drive piston preventing cavitation of the pump.

The cylinder also has a plurality of ports formed through its surface to allow excess lubricant, that would otherwise decrease the stroke length of the drive piston, to flow back into the pump housing. Excess lubricant can also flow back up the pipe and into the upper hollow portion of the connecting rod to provide a full stroke area for the drive piston to move. By providing ports that allow excess lubricant to flow back into the pump housing, and holes in the pipe that allow excess lubricant to flow therewithin, the drive piston can achieve its full stroke. The greater the area in the pumping chamber, the larger the drive piston stroke. As any excess lubricant can flow from the pumping chamber to the pump housing, the internal pressure in the pumping chamber will be minimized. Additionally, as the lubricant is freely transferred from the pumping chamber to the pump housing the lubricant in the pumping chamber remains cool. As the drive piston can achieve its full stroke, it can pump the system solution at pressures below atmospheric pressure.

Additional features and advantages of the present invention will become apparent to one of skilled in the art upon consideration of the following detailed description of the present invention.

BRIEF DESCRIPTIONS OF THE DRAWINGS

A preferred embodiment of the present invention is described by reference to the following drawings.

DETAILED DESCRIPTION OF THE PREFERRED EMBODIMENT

Figure 1:
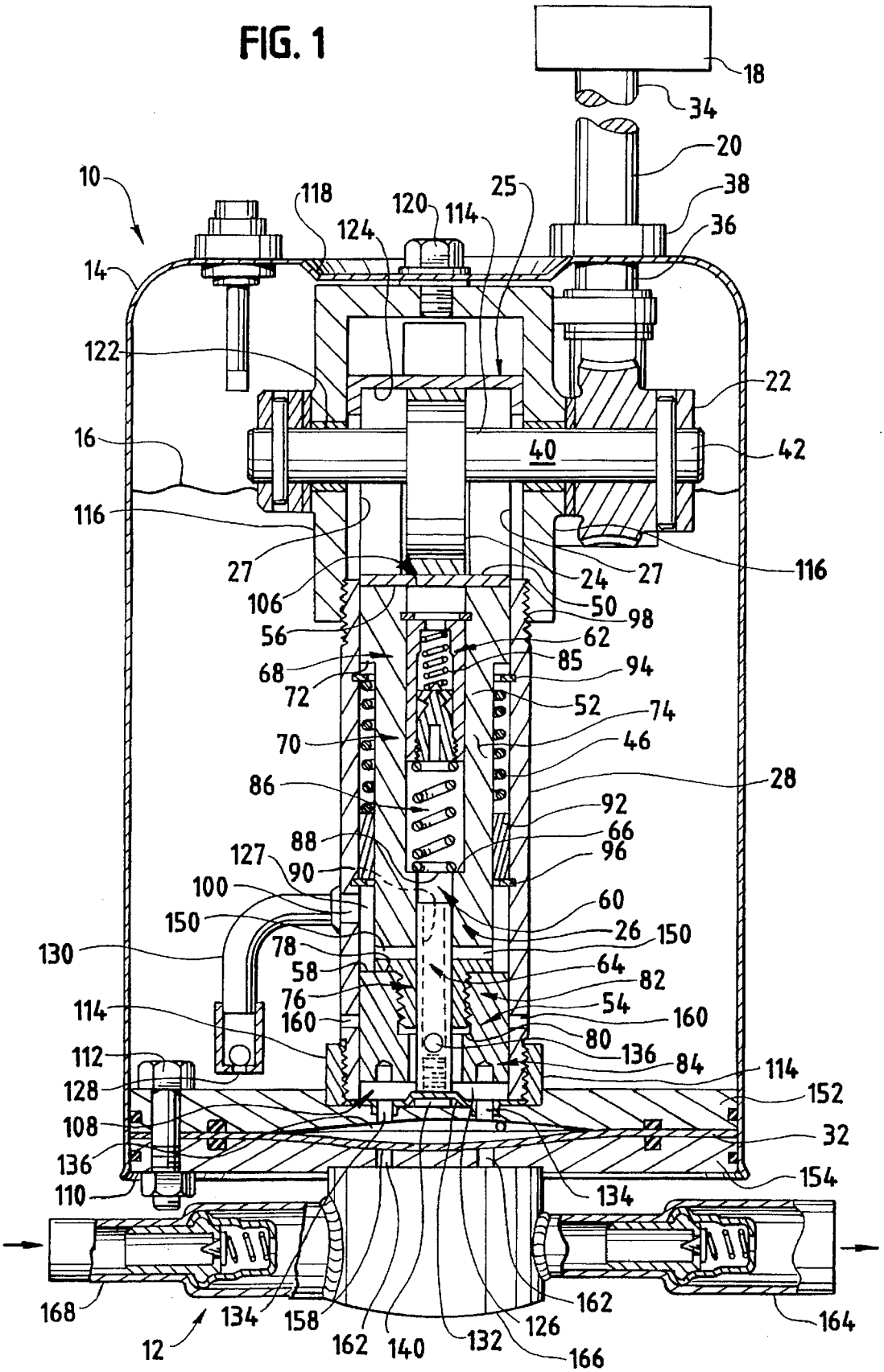
FIG. 1 is a cross-sectional view of a hydraulic solution pump in the compression stroke in accordance with a preferred embodiment of the present invention.
Figure 2:
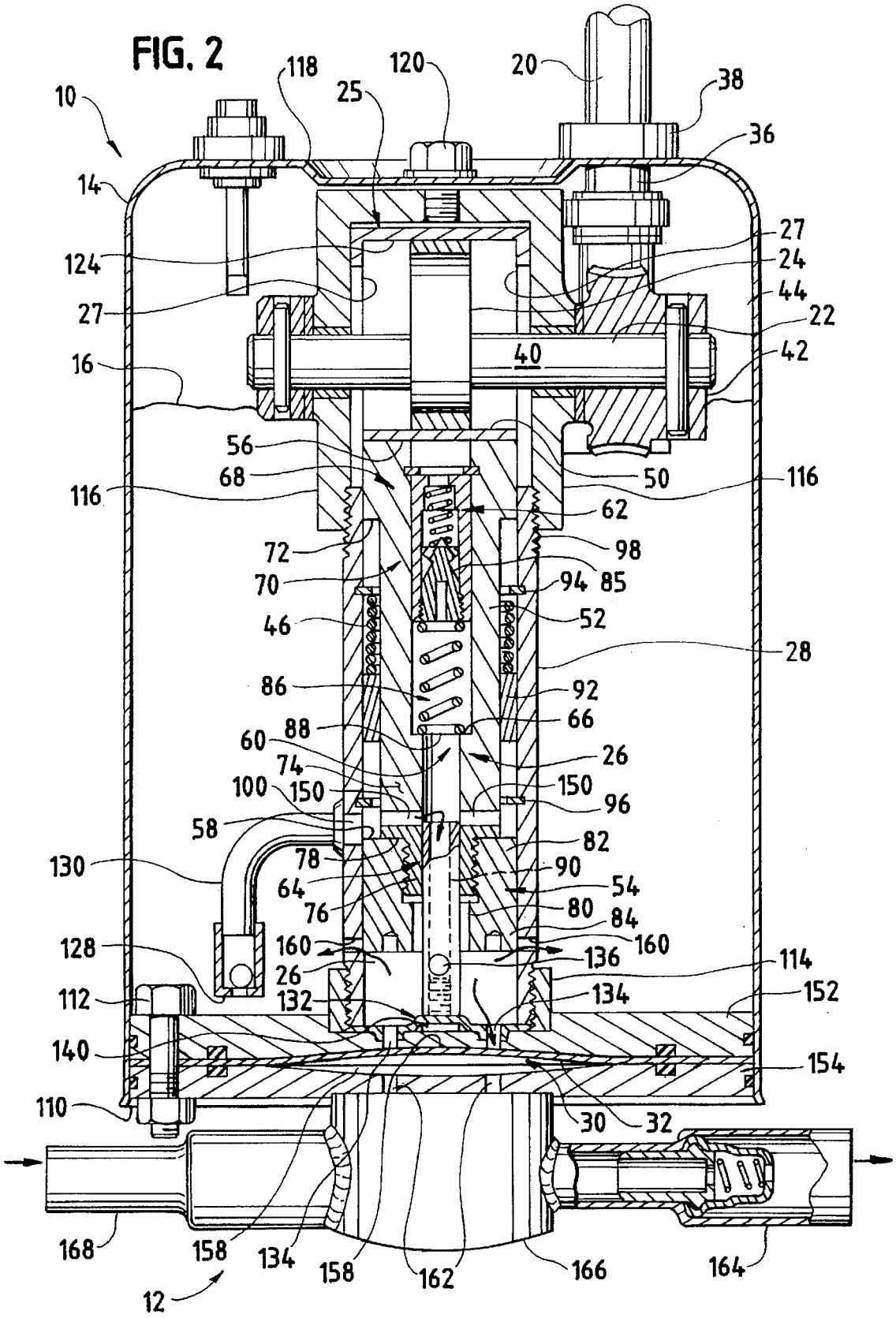
FIG. 2 is a cross-sectional view of a hydraulic solution pump in the decompression stroke in accordance with a preferred embodiment of the present invention.

Turning first to FIGS. 1 and 2, a hydraulic solution pump is disclosed and is generally indicated by reference number 10. In the preferred embodiment, the hydraulic pump 10 is part of an ammonia absorption heating and cooling system 12. Alternatively, the pump 10 may be used with any system that can utilize its specifications. In the preferred embodiment, the pump 10 operates to force ammonia or any other system solution through the absorption heating and cooling system 12 and provide the ammonia or other system solution to the system 12 at a pressure below atmospheric.

In the preferred embodiment, the pump 10 includes a pump housing 14 that is filled with a predetermined amount of hydraulic fluid or lubricant, as generally indicated by number 16, a generator 18, a drive shaft 20 that is mechanically connected to the generator 18, a gear 22 that is mechanically connected to the drive shaft 20, a cam 24 that is mechanically connected to the gear 22, a piston assembly 26 that mechanically communicates with the cam 24, a cylinder 28 that houses the piston assembly 26, and a transfer chamber 30 with a flexible diaphragm 32 contained therein. The lubricant is preferably oil, but can be any other conventional hydraulic fluid. The pump housing 14 acts as a reservoir for the lubricant (hydraulic fluid) and can be easily accessed. As the pump housing 14 can be easily accessed, the lubricant can be changed or additional lubricant can be added without disturbing the system. Additionally, the pump components encapsulated in the pump housing 14 are accessible for replacement or repair without the need to open the system 12.

The hydraulic pump 10 is driven by the generator 18. The generator 18 is preferably an electric motor that is located outside of the pump housing 14. The generator however, may be any conventional means sufficient to drive the pump 10. In an alternative embodiment, the generator 18 may be located within the pump housing 14.

The generator 18 is mechanically connected to a drive shaft 20 at a first end 34. The drive shaft 20 extends through the pump housing 14 such that a second end 36 of the drive shaft 20 is mechanically connected to the gear 22 that is located within the pump housing 14. The drive shaft 20 has a shaft seal 38 surrounding it at the point it enters the pump housing 14 to ensure that the pump housing 14 remains hermetically sealed. The gear 22 is preferably a worm gear, but can be any other kind of commercially available gear, and is mechanically connected to a connecting bar 40. The connecting bar 40 is mechanically connected to the cam 24. The cam 24 is located above the piston assembly 26 so that when the cam 24 rotates, it will contact the piston assembly 26 forcing it downward into its compression stroke.

In operation, when the generator 18 is active, it will drive the drive shaft 20 causing the gear 22 to turn. As the gear 22 is mechanically connected to a first end 42 of the connecting bar 40, the connecting bar 40 will rotate as the gear 22 turns. The connecting bar 40 is mechanically connected at a second end 44 to the cam 24 which causes it to turn as the connecting bar 40 rotates. The cam 24 is encapsulated within a piston box 25. The piston box 25 surrounds the cam 24 and has a cap 124 located above the cam 24, as discussed below. The piston box 25 is connected to the piston assembly 26 via sidewalls 27. Rotation of the cam 24 causes the piston box 25 and its sidewalls 27 to move upwardly and downwardly in response to the rotation of the cam 24. As the cam 24 rotates and the piston box 25 moves, the piston assembly 26 is caused to move upwardly and downwardly within the cylinder 28. As the cam 24 rotates, it causes the piston box 25 to move upward and lift the piston assembly 26 through its return stroke. While the piston assembly 26 moves upward, a biasing spring 44 that surrounds the piston assembly 26, and is located between the piston assembly 26 and the cylinder 28, will be compressed. As the cam 24 continues to rotate, the piston box 25 will move downward in connection with the biasing spring 46 to force the piston assembly 26 to move in a downward direction within the cylinder 28. The cylinder 28 is machine honed such that the piston assembly 26 moves within without unnecessary wear and tear on the inner walls of the cylinder 28. This machining process is well known to one of ordinary skill in the art.

As shown in FIGS. 1 and 2, the piston assembly 26 is comprised of a top plate 50, a connecting rod 52, the drive piston 54, and the piston box 25 (as described above). The top plate 50 has a diameter that is approximately equal to the inner diameter of the cylinder 28 allowing the top plate 50 to move within the cylinder 28. The top plate 50 is the portion of the piston assembly 26 that is located below the rotating cam 24 and is connected to the sidewalls 27 to force the piston assembly 26 downward. The bottom portion 56 of the top plate 50 rests upon the top portion of the connecting rod 52.

The connecting rod 52 extends from the bottom 56 of the top plate 50 to the top 58 of the drive piston 54. The connecting rod 52 has a hollow portion 60 that extends throughout the middle of entire connecting rod 52. The hollow portion 60 of the connecting rod 52 is comprised of an upper hollow portion 62 and a lower hollow portion 64. The upper hollow portion 62 has a larger inner diameter then the inner diameter of the lower hollow portion 64. As a result of the varying diameters, a step 66 is formed at the top of the lower hollow portion 64 where the upper hollow portion 62 and the lower hollow portion 64 are joined.

The upper hollow portion 62 has a top section 68 and a bottom section 70. The top section 68 of the upper hollow portion 62 is located at the portion of the connecting rod 52 that contacts the bottom 56 of the top plate 50. The top section 68 has an outer diameter that is greater than the outer diameter of the bottom section 70. As the top section 68 and bottom section 70 of the upper hollow portion 62 have different outer diameters, a ridge 72 is formed at the bottom of the top section 68 where the top section 68 and bottom section 70 are joined. The outer diameter of the top section 68 is approximately equal to the inner diameter of the cylinder 28. This stabilizes the connecting rod 52 therewithin. The top section 68 and the bottom section 70 of the upper hollow portion 62 have the same inner diameter.

The lower hollow portion 64 includes a top section 74 and a nose section 76. The top section 74 of the lower hollow portion 64 has a greater outer diameter than the outer diameter of the nose section 76. As a result of these varying diameters, a ledge 78 is formed at the bottom of the top section 74 where the top section 74 and the nose section 76 are joined. The ledge 78 rests on and is joined to the top surface 58 of the drive piston 54. The nose section 76 of the lower hollow portion 64 is partially telescoped into the drive piston 54 and is connected to a step 80 formed inside the drive piston 54. The step 80 is formed where the upper portion 82 of the drive piston 54 meets the lower portion 84 of the drive piston 54. The step 80 is formed because the lower portion 84 of the drive piston 54 has a smaller inner diameter than the inner diameter of the upper portion 82 of the drive piston 54.

A high pressure relief valve 85 is preferably included in the upper hollow portion 62 of the connecting rod. A spring mechanism 86 is included below the valve 85 in the upper hollow portion 62 and holds the high pressure relief valve 85 in place and has a bottom 88 which rests on the step 66 to aid in positioning the valve 85.

A sleeve 92 is positioned around a portion of the bottom section 70 of the upper hollow portion 62 of the connecting rod 52. The sleeve 92 is positioned around the outside of the connecting rod 52 so that it can slide freely thereover. Located above and attached to the sleeve 92 is a biasing spring 46 that encircles the lower section 70 of the upper hollow portion 62 of the connecting rod 52. The biasing spring 46 is in its relaxed position when the drive piston assembly 26 is at the bottom of its downward stroke, as shown in FIG. 1. Conversely, the biasing spring 46 is in a compressed position in the upward stroke of the piston assembly 26, as shown in FIG. 2.

In the preferred embodiment, a pair of rings 94, 96 are positioned around the connecting rod 52 and have an outer diameter that is approximately equal to the inner diameter of the cylinder 28 such that they are secured to the inside of the cylinder 28 and allow the connecting rod 52 to move therewithin. The upper ring 94 is positioned below threads 98 formed in the outer surface of the cylinder 28. The upper ring 94 is located above and attached to the biasing spring 46. The lower ring 96 is positioned above the lubricant intake port 100 and below the sleeve 92. The upper ring 94 and the lower ring 96 are designed to limit the stroke length through which the sleeve 92 can travel.

As shown in FIG. 1, the lower ring 96 is designed to contact the sleeve 92 on the compression stroke and thereby limit the downward movement of the sleeve 92. Similarly, as shown in FIG. 2, the upper ring 94 contacts the upper portion of the biasing spring 46 and thereby limits the upward stroke of the sleeve 92. As the piston assembly 26 moves downward, the sleeve 92 moves downward with the piston assembly 26 and stretches the biasing spring 46 from its compressed position (FIG. 2). The downward movement of the piston assembly 26 is not limited by the sleeve 92 contacting the lower ring 96. The unstressed spring (FIG. 1) will compress as the sleeve 92 and the piston assembly 26 move through the return stroke until the biasing spring 26 is fully compressed against the upper ring 94.

With reference to FIGS. 1, 2, 5, and 6, the drive piston 54 is also part of the piston assembly 26 and is mechanically connected to the lower hollow portion 64 of the connecting rod 52. The outer diameter of the drive piston 54 is approximately equal to the inner diameter of the cylinder 28. This dimension allows the drive piston 54 to move within the cylinder 28 while preventing the lubricant that lies below the drive piston 54 from leaking by the sides of the drive piston 54 on the compression stroke.

The piston assembly 26 moves upwardly and downwardly within the cylinder 28. The cylinder 28 is honed and has a uniform inner and outer diameter and is open at both its top 106 and bottom ends 108. The bottom end 108 of the cylinder 28 is fixably attached to a bottom plate 110 at the base of the pump housing 14 by means of a bolt 112. The bottom 108 of the cylinder 28 is further stabilized by a cylinder retainer 114 that is inserted into the bottom plate 110 and is threaded to the cylinder 28. The top 106 of the cylinder 28 is secured in place by a cylinder-shaped support 116 that extends from the top 118 of the pump housing 14. The support 116 is attached to the cylinder 28 by means of the threads 98. The cylinder-shaped support 116 is preferably constructed of one piece and is attached to the top 118 of the pump housing 14 by a bolt 120. The cylinder-shaped support 116 also has a passageway 122 for receiving the connecting bar 40. A cylindrical cap 124 is also located within the cylinder-shaped support and is attached to the top 106 of the cylinder 28. The cap 124 is affixed to the top of the piston assembly 26 via sidewalls 27. The cap 124 surrounds and is movable with the cam 24. As shown in FIG. 2, as the cam 24 rotates, the piston assembly 26 is moved to its return stroke by the cap 124.

The cylinder 28 includes a pumping chamber 126 that is located below the drive piston 54 and extends through ports 134 to the top portion 152 of the bottom plate 110. The cylinder 28 also includes a lubricant holding chamber 127. The lubricant holding chamber 127 surrounds the piston assembly 26 and is bounded by the inner walls of the cylinder 28, the bottom of the lower ring 96, and the top of the drive piston 54.

The cylinder 28 also preferably includes a lubricant check valve 128 to regulate the amount of lubricant that is brought into the lubricant holding chamber 127 inside of the cylinder 28. The valve 128 is pressure regulated. When the piston assembly 26 is moved downward in compression toward the diaphragm 32, the area above the drive piston 54 and below the lower ring 96—the lubricant holding chamber 127—increases. This increase in area draws lubricant into the check valve 128 from the pump housing 14. The lubricant is drawn up through an inlet tube 130, through the lubricant intake port 100, and into the lubricant holding chamber 127 of the cylinder 28. The lubricant intake port 100 is preferably formed through the cylinder 28 below the lower ring 96.

Figure 3:
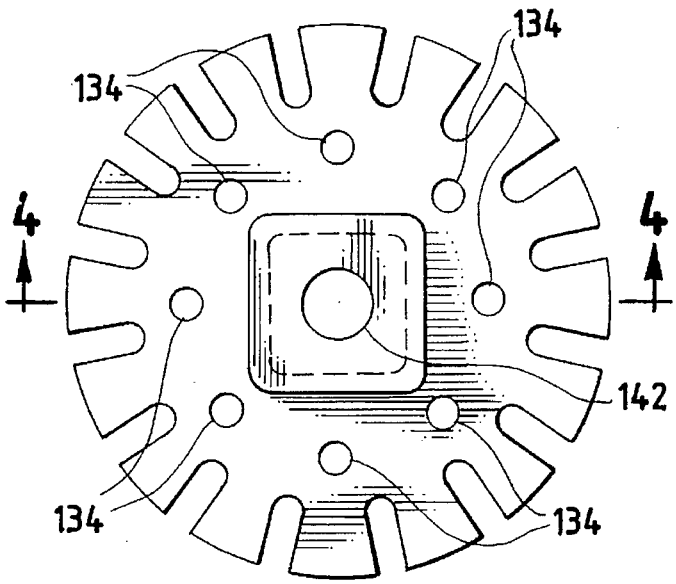
FIG. 3 is a front view of the base of the pipe in accordance with the preferred embodiment of FIG. 1.
Figure 4:
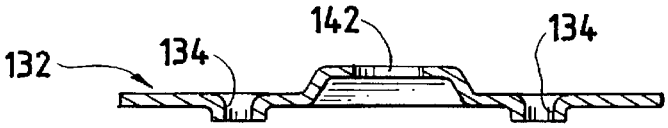
FIG. 4 is a cross-sectional view of the base of the pipe along the line 4—4 in FIG. 3.
Figure 5:
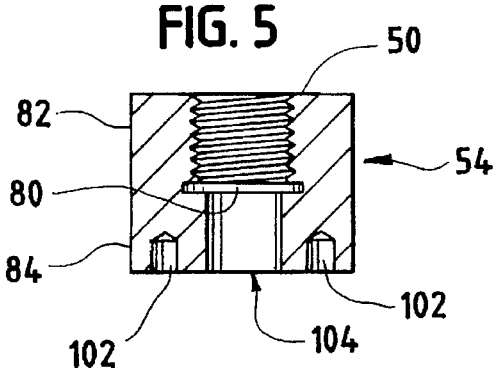
FIG. 5 is a cross-sectioned view of the drive piston in accordance with the preferred embodiment of FIG. 1.
Figure 6:
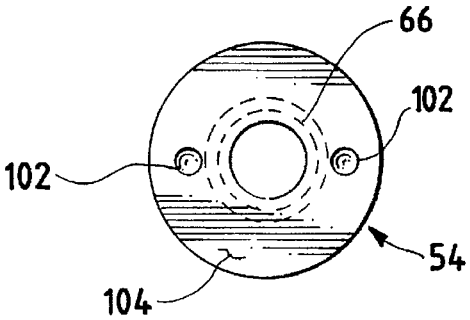
FIG. 6 is a bottom view of the drive piston in accordance with the preferred embodiment of FIG. 1.

A pipe 90 is preferably located within the lower hollow portion 64 of the connecting rod 52 and extends from below the spring mechanism 86 to the base plate 110 through the hollow piston 54. The pipe 90 includes a base 132 located at the bottom of the pipe 90. The base 132 is located above the transfer chamber 30 and secured to the top portion 152 of the bottom plate 110. The base 132 is attached to the pipe 90 by a screw 140 that fits through hole 142 (FIG. 3) in the base 132. The head of the screw 140 rests against the bottom plate 110 of the pump housing 14. The base 132 of the pipe 90 is shown in more detail in FIGS. 3 and 4. In the preferred embodiment, the base 132 has eight (8) passageways 134 formed therethrough that allow the lubricant to flow from the pumping chamber 126 into the transfer chamber 30. The lubricant is forced through the passageways 134 by the piston 54 during each compression stroke of the piston assembly 26. More or less passageways may be utilized.

The pipe also has at least one port 136 formed therethrough. The port 136 is formed in the pipe 90 and allows lubricant to flow therethrough into the pumping chamber 126 below the piston 54. The port 136 is located in the pipe 90 above the screw 140 and thus when the lubricant reaches the screw 140 it has reached the bottom of the pipe 90. The number of ports 136 formed in the pipe 90 is preferably two (2), but can be more or less depending upon the amount of lubrication required.

A plurality of ports 150 are bored through the connecting rod 52 and allow lubricant to flow therethrough. When the piston assembly 26 is moving in compression, the passage of lubricant through the ports 150 is blocked by the pipe 90. When the piston assembly 26 is moving in decompression, the connecting rod ports 150 move with the piston assembly 26 until the ports 150 are located above the open end of the tube 90. When the ports 150 are located above the open end of the tube 90, the lubricant brought into the lubricant holding chamber 127 through the lubricant intake port 100 flows through the ports 150, down the pipe 90 and out the port 136. The flow of lubricant through the ports 150 and down the pipe 90 is shown in FIG. 2.

A plurality of ports 160 are formed through the housing of the cylinder 28. As the piston assembly 26 travels through its return stroke, the cylinder ports 160 are located below the drive piston 54 (FIG. 2). The location of the cylinder ports 160 with respect to the drive piston 54 allows any excess lubricant that may have leaked between the drive piston 54 and the cylinder 28, during the compression stroke, to be discharged back to the pump housing 14. These ports 160 provide the advantage of allowing excess lubricant located below the drive piston 54 to exit the cylinder 28 into the pump housing 14 on the compression stroke of the drive piston 54. The amount of excess lubricant that remains in the pumping chamber 126 is directly proportional to the displacement of the drive piston 54 (stroke length). By the removal of excess lubricant, the drive piston is allowed to travel through a full stroke. This allows the drive piston 54 to pump the system solution below atmospheric pressure. The number of ports 160 and the exact size of the ports 160 are directly related to the efficiency of the pump. Because pumps can be made to operate at higher speeds, it is harder to force out the excess oil between compression strokes.

In the preferred embodiment, lubricant is sucked into the lubricant intake valve 128 and into the lubricant holding chamber 127 during the downward stoke of the piston 54. On the upward stroke of the piston 54, lubricant from the lubricant holding chamber 127 is conveyed to the lower and upper hollow portions 62, 64 of the connecting rod 52. Because of the pressure in the pumping chamber 126 the lubricant does not immediately flow down the pipe 90, but remains in the upper and lower hollow portions 62, 64, until the port 150 reaches and passes the top of the pipe 90, at the top of the upward stroke of the piston.

The number of cylinder ports 160 may vary to optimize the discharge of surplus oil and still prevent cavitation. In the preferred embodiment, two ports are included and they are ⅛ of an inch in diameter. More or less ports may be employed as well as ports of various sizes. Excess lubricant can also be forced back through the pipe port 136 into the pipe 90 on the compression stroke, if excess oil is present below the drive piston 54. The pipe 90 which is open at its top end allows lubricant to flow into the upper hollow portion 62 of the connecting rod 52. The hollow pipe 90 and the upper hollow portion 62 accommodate excess lubricant located below the drive piston 54 allowing the piston assembly 26 to travel through its full stroke and provide for an efficient pump 10. Moreover, as the ports 160 allow lubricant to flow from the pumping chamber 128 to the pump housing 14, the lubricant used to lubricate the piston 54 will remain relatively cool.

The transfer chamber 30 is located below the base 132 of the pipe 90. The transfer chamber 30 has at least one diaphragm 32 contained therein. The diaphragm 32 is made of a flexible membrane and is not mechanically attached to any moving component of the pump 10. In a preferred embodiment, two diaphragms 32 are included. The second diaphragm (not shown) prevents oil from leaking into the system 12 in the event that the first diaphragm 32 ruptures or develops a leak. As shown in FIGS. 1 and 2, the diaphragm 32 is sandwiched between a top portion 152 and a bottom portion 154. The diaphragm 32 separates the transfer chamber 30 into two sections, a lubricant section 156 and a system solution section 158. The lubricant section 156 receives the lubricant through the passageways 134 in the base 132 of the pipe 90 during the compression stroke from the pumping chamber 126. The system solution section 158 receives the system solution to be pumped through the system through a plurality of passageways 162, which are preferably located directly below the passageways 134 and are of the same dimensions as passageways 162.

As shown in FIGS. 1 and 2, the system solution is drawn through an intake valve 168 into the header 166 and up into the system solution section 158 of the transfer section 30 when the drive piston 54 is in decompression mode (FIG. 2). As the drive piston 54 moves away from the transfer chamber 30, the diaphragm 32 flexes toward the pumping chamber 126 as a result of the suction pressure from the drive piston 54. This suction pressure and flexing of the diaphragm 32 draws system solution through the passageways 162 and into the system solution section 158 of the transfer chamber 30. When the drive piston 54 is in compression mode (FIG. 1), lubricant in the pumping chamber 126 is forced through the passageways 134 into the lubricant section 156 of the pumping chamber 30, and against the diaphragm 32. The diaphragm 32 flexes downward, as shown in FIG. 1, forces system solution from the solution section 158 of the transfer chamber 30, out passageways 162, into the header 166, and out an outake valve 164 for use in the system 12.

In operation, the drive piston 54 is forced downwardly as a result of the rotation of the cam 24. As the drive piston 54 moves downward, lubricant is forced into the transfer chamber 30 and into contact with the diaphragm 32 causing it to flex downward. This pressure on the diaphragm 32 forces system solution that is located in the system section 158 of the transfer chamber 30 to be discharged out the outlet valve 164 for use in the corresponding system 12. As the drive piston 54 is forced upward by the movement of the cam 24, a suction force is created and the diaphragm 32 flexes upward. This suction causes system solution to be brought through the intake valve 168 of system 12 and into the system header 166. This suction pressure is created by the upward movement of the piston assembly 26 and the resistance of the lubricant to separation. The pressure is necessary to return the diaphragm 32 to its position and bring system solution into the transfer chamber 30.

While only one preferred embodiment of the invention has been described hereinabove, those of ordinary skill in the art will recognize that this embodiment may be modified and altered without departing from the central spirit and scope of the invention. Thus, the embodiment described hereinabove is to be considered in all respects as illustrative and not restrictive, the scope of the invention being indicated by the appended claims, rather than by the foregoing descriptions, and all changes which come within the meaning and range of equivalency of the claims are intended to be embraced herein.

What is claimed is:

1. A hydraulic pump for pumping a solution through a system comprising:

a pump housing for storing a predetermined amount of lubricant, said pump housing communicating with inlet and outlet valves for regulating a flow of pumped solution through said pump housing;

a cylinder located within said pump housing;

a reciprocating piston located within said cylinder, said piston moving between compressed and decompressed positions during compression and decompression strokes, respectively;

a transfer chamber, communicating with inlet and outlet ports, for receiving and discharging the pumped solution, said transfer chamber being in fluid communication with said piston, said transfer chamber including a diaphragm driven by said piston to pump the solution;

a sleeve slidably received between said piston and cylinder; and a biasing member received between said piston and cylinder for applying a biasing force upon said sleeve in a compression direction during said compression and decompression strokes of said piston, said piston, cylinder and sleeve cooperating to define a lubricant holding chamber therebetween, said cylinder having a lubricant intake port and intake valve associated with said intake port, said intake valve regulating a flow of lubricant to said lubricant holding chamber, said lubricant holding chamber fluidly communicating with said transfer chamber, said piston, cylinder, sleeve and biasing member forcing lubricant from said lubricant holding chamber into said transfer chamber during at least one of said compression and decompression strokes.

2. The hydraulic pump of claim 1 wherein the pumped solution is ammonia.

3. The hydraulic pump of claim 1 wherein the lubricant is oil.

4. The hydraulic pump of claim 1 further comprising a cam assembly for driving said piston.

5. The hydraulic pump of claim 1, wherein said cylinder includes upper and lower rings secured to an inner wall thereof, said upper and lower rings surrounding said sleeve and biasing member and defining a range of motion of said sleeve during said compression and decompression strokes.

6. The hydraulic pump of claim 1, further comprising:

a hollow portion extending along a middle section of said piston;

a port in said piston fluidly connecting said hollow portion and said lubricant holding chamber; and a pipe slidably received within said hollow portion of said piston, said pipe being affixed relative to said pump housing, said pipe and port in said piston cooperating to transfer lubricant from said lubricant holding chamber to said transfer chamber during at least one of said compression and decompression strokes.

7. The hydraulic pump of claim 1, wherein lubricant is sucked into said lubricant holding chamber during said compression stroke.

8. A hydraulic pump for pumping a solution through a system comprising:

a pump housing for storing a predetermined amount of lubricant, said pump housing communicating with inlet and outlet valves for regulating a flow of pumped solution through said pump housing;

a cylinder located within said pump housing;

a reciprocating piston located within said cylinder, said piston moving between compressed and decompressed positions during compression and decompression strokes, respectively;

a transfer chamber communicating with inlet and outlet ports for receiving and discharging the pumped solution;

a hollow portion extending along a middle section of said piston;

a pipe slidably received within said hollow portion of said piston, said pipe being affixed relative to said pump housing;

at least one intake port provided in said cylinder and communicating with said hollow portion of said piston; and an intake valve proximate said intake port for regulating a flow of lubricant to said hollow portion of said piston, said pipe and piston cooperating to transfer a predefined amount of lubricant to said transfer chamber during at least one of said compression and decompression strokes.

9. A hydraulic pump according to claim 8, further comprising:

a lubricant biasing assembly slidably received between said piston and cylinder, said piston, cylinder and lubricant biasing assembly cooperating to define a lubricant holding chamber therebetween, said lubricant holding chamber communicating with said transfer chamber, said intake valve regulating a flow of lubricant to said lubricant holding chamber, said lubricant biasing assembly forcing lubricant from said lubricant holding chamber into said hollow portion of said piston during at least one of said compression and decompression strokes.

10. A hydraulic pump according to claim 9, wherein said lubricant biasing assembly further comprising a sleeve and a spring, received between said piston and cylinder, said spring biasing said sleeve in a compression direction during at least one of said compression and decompression strokes.

11. The hydraulic pump of claim 8 wherein said pumped solution is ammonia.

12. The hydraulic pump of claim 8 wherein the lubricant is oil.

13. The hydraulic pump of claim 8 further comprising a cam assembly for driving said piston.

14. The hydraulic pump of claim 9, wherein said cylinder includes upper and lower rings secured to an inner wall thereof, said upper and lower rings surrounding said biasing assembly and defining a range of motion of said sleeve during said compression and decompression strokes.

* * * * *